US008512169B2

(12) United States Patent
Bohannon

(10) Patent No.: US 8,512,169 B2
(45) **Date of Patent: *Aug. 20, 2013**

(54) GREEN REPAIR TOOL, GOLF ACCESSORY, AND COMBINATION GOLF BALL MARKER RETENTION AND GREEN REPAIR TOOL DEVICE

(75) Inventor: Jeremiah Bohannon, Emerald Hills, CA (US)

(73) Assignee: Frogger, LLC, San Mateo, CA (US)

( * ) Notice: Subject to any disclaimer, the term of this patent is extended or adjusted under 35 U.S.C. 154(b) by 340 days.

This patent is subject to a terminal disclaimer.

(21) Appl. No.: 12/954,801

(22) Filed: Nov. 26, 2010

(65) Prior Publication Data

US 2012/0135824 A1 May 31, 2012

(51) Int. Cl.
*A63B 57/00* (2006.01)

(52) U.S. Cl.
USPC ..... 473/408; 473/406

(58) Field of Classification Search
USPC ..... 473/408, 406, 285, 286; D21/793
See application file for complete search history.

(56) References Cited

U.S. PATENT DOCUMENTS

| | | | | | |
|---|---|---|---|---|---|
| D249,814 | S | * | 10/1978 | Cudahy, III | D21/793 |
| 4,386,774 | A | * | 6/1983 | Buckman | 473/406 |
| 4,856,132 | A | | 8/1989 | Burns et al. | |
| 4,984,790 | A | * | 1/1991 | Dowdy et al. | 473/408 |
| 5,121,519 | A | * | 6/1992 | Haugom | 15/105 |
| 5,393,052 | A | * | 2/1995 | Kennedy | 473/285 |
| 5,529,299 | A | * | 6/1996 | Bellagamba | 473/285 |
| 5,643,114 | A | | 7/1997 | Marcus | |
| 6,033,322 | A | * | 3/2000 | England | 473/408 |
| 6,224,502 | B1 | * | 5/2001 | Warfield | 473/408 |
| 6,413,173 | B1 | * | 7/2002 | Muller et al. | 473/408 |
| 6,422,955 | B1 | | 7/2002 | Lopez | |
| 6,546,981 | B2 | * | 4/2003 | Cameron | 150/160 |
| 6,645,092 | B1 | * | 11/2003 | Hendren | 473/408 |
| 7,004,858 | B2 | * | 2/2006 | Bauley et al. | 473/408 |
| 7,008,336 | B2 | | 3/2006 | Bores | |
| 7,238,125 | B2 | | 7/2007 | Dymling | |
| 7,611,426 | B1 | * | 11/2009 | Bradshaw | 473/408 |
| 7,716,859 | B1 | | 5/2010 | Chen | |
| D647,992 | S | * | 11/2011 | Bohannon | D21/793 |
| 2007/0082758 | A1 | * | 4/2007 | Widmann | 473/406 |
| 2007/0149325 | A1 | * | 6/2007 | Vargas | 473/408 |
| 2007/0219023 | A1 | * | 9/2007 | Stanley | 473/408 |
| 2008/0268985 | A1 | * | 10/2008 | Wiens et al. | 473/408 |
| 2009/0054178 | A1 | * | 2/2009 | Perry | 473/406 |

* cited by examiner

*Primary Examiner* — Steven Wong
(74) *Attorney, Agent, or Firm* — Charter IP, LLC; Matthew J. Lattig

(57) ABSTRACT

A golf accessory for retaining a marker therein, the accessory having a body, the upper end thereof including a semi-circular recess dimensioned to receive a removable metallic ball marker fixedly retainable within the recess. The accessory includes a pair of spaced prongs contiguous with and extending downward from the lower end of the body to prong tips, a first plurality of magnets embedded in the body adjacent the semi-circular recess, and a second plurality of magnets embedded in the spaced prongs.

20 Claims, 4 Drawing Sheets

GREEN REPAIR TOOL, GOLF ACCESSORY, AND COMBINATION GOLF BALL MARKER RETENTION AND GREEN REPAIR TOOL DEVICE

BACKGROUND

1. Field

Example embodiments in general relate to a green repair tool, an accessory for retaining a ball marker therein, and a device combining ball mark repair tool and ball marker retention functions.

2. Related Art

Green repair tools having a ball mark retention function are used by golfers today. Well known golf accessories for repairing greens including a body having prongs extending therefrom to repair the turf around and in the ball mark depression so as to repair the golf green. The body typically will have a circular recess with a magnetized backing to receive a metallic disc ball marker thereon. Other green repair tools may have a slot in the body through which the marker is inserted, and a finger aperture or opening in the body side that allows the golfer to push the marker up through the slot so as to retrieve the marker therefrom.

However, conventional green repair tools do not solve the problem where the marker is continually separated from the body of the tool during a round of golf. Depending on the clothes the golfer may be wearing or the equipment the golfer may be carrying, ball markers may be carried in their pockets, a bag, or in or around a golf bag. But due to the size and shape of the green repair tool recess or slot which captures the ball marker therein, it does not easily attract or capture the ball marker when the ball marker is dropped into a golfer's pocket. Golfer's typically must reattach the ball marker back into the recess or slot for the magnet to hold the ball marker. Numerous attempts to solve this problem of carrying golf ball markers in a convenient and accessible place while playing a game of golf to date have not necessarily proven successful. This is because during normal golf play, a golfer will use in one or both the ball marker and green repair tool on a golf green but insert them back into their pocket at different times due to the normal procedure of play. Thus, the ball marker is dropped into the golfer's pocket separate from the green repair tool and does not become attached. The next time a golfer must find his ball marker, it is not readily clear where the ball marker is in their pocket and it is not attached where it should be to the green repair tool unless the golfer has gone through the trouble of manually re-inserting the ball marker in it's slot or recess position in the green repair tool. Therefore, golfers are commonly found digging in their pockets searching for their ball marker amongst many other items in their pocket, such as the green repair tool, golf tees, golf ball, score card, score card pencil and other various items.

SUMMARY

An example embodiment is directed to a green repair tool. The tool includes a body having a front surface, rear surface, upper end, lower end, left and right sides thereof, the upper end terminating in a generally crescent shape; a pair of spaced prongs contiguous with and extending downward from the lower end of the body to prong tips; and a horizontal contour ridge jutting outward from the rear surface at approximately a midpoint of the body and tapering to form rear upper end portions of the prongs. The crescent-shaped upper end includes a semi-circular recess formed downward within the body and dimensioned to receive a removable ball marker fixed retainable within the recess so less than 50% of the total surface area of the marker is exposed above the crescent-shaped upper end.

Another example embodiment is directed to a golf accessory. The accessory includes a body having a front surface, rear surface, upper end, lower end, left and right sides thereof, the upper end including a semi-circular recess formed downward within the body and dimensioned to receive a removable metallic ball marker fixedly retainable within the recess. The accessory includes a pair of spaced prongs contiguous with and extending downward from the lower end of the body to prong tips, a first plurality of magnets embedded in the body adjacent the semi-circular recess, and a second plurality of magnets embedded in the spaced prongs.

Another example embodiment is directed to a combination golf ball marker retention and green repair tool device. The device includes a body having a front surface, rear surface, upper end, lower end, left and right sides thereof, the upper end terminating in a crescent shape and including a semi-circular recess formed downward within the body and dimensioned to receive a removable metallic ball marker fixedly retainable within the recess. The combination further includes a horizontal contour ridge jutting outward from the rear surface of the body lower end and tapering to form rear upper end portions of the prongs, a pair of spaced prongs contiguous with and extending downward from the lower end of the body to prong tips, and a plurality of magnets embedded in the body and prongs so that at least 60% of the outer surface area of the device is receptive to retaining the ball marker thereon.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

As used herein, the phrase "green repair tool" is directed to a device configured to repair a golf putting green surface, and/or a ball mark depression made by a spike or golf ball on a green or fairway of a golf course. A green repair tool may be synonymous with a "divot tool" or "divot repair device" and the like, as is known in the golf industry.

As used herein, the phrase "golf accessory" where used, is a device configured to removably retain or hold a ball marker thereto or therein. The golf accessory may also include functionality for repairing a divot or ball mark depression on a putting green or fairway of a golf course for example.

Where used herein, a "golf ball marker retention and green repair tool device" represents a combination article, device, apparatus, etc. Any one of a green repair tool, golf accessory and/or combination could occasionally be used hereafter in conjunction with describing various ones of the example embodiments, it being understood that one or more of the example embodiments may include functionality directed to retaining a ball marker therein and/or retaining the ball marker on external surface area of the body of the device/tool/accessory, etc, and repairing a divot; some of these functions or all of these functions.

Figure 1:
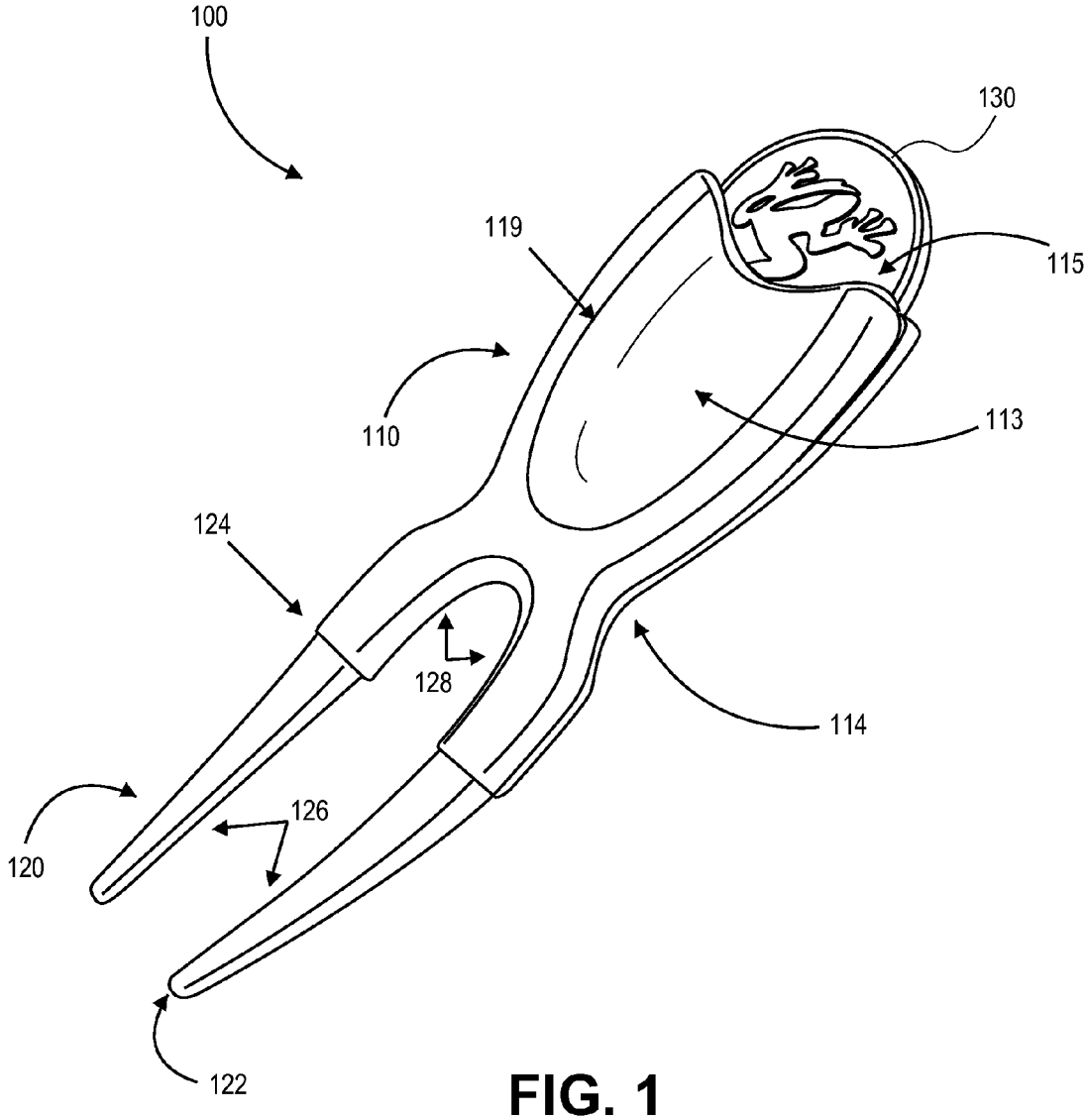
FIG. 1 is a perspective view of a green repair tool in accordance with the example embodiments.
Figure 2:
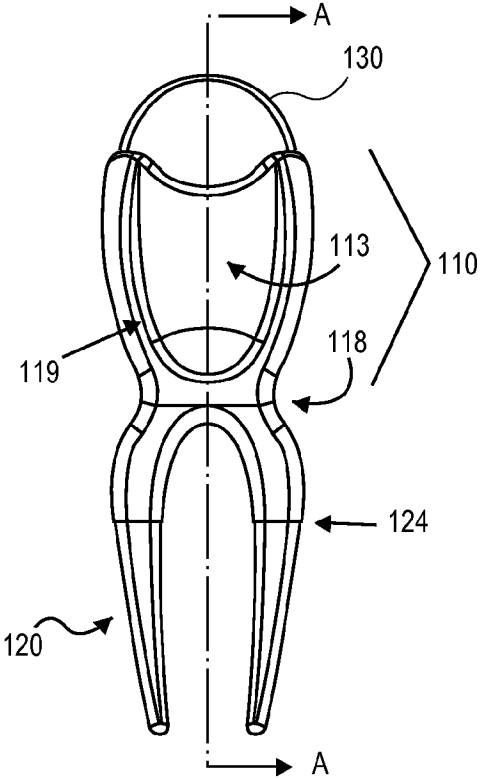
FIG. 2 is a front plan view of the tool from FIG. 1.
Figure 3:
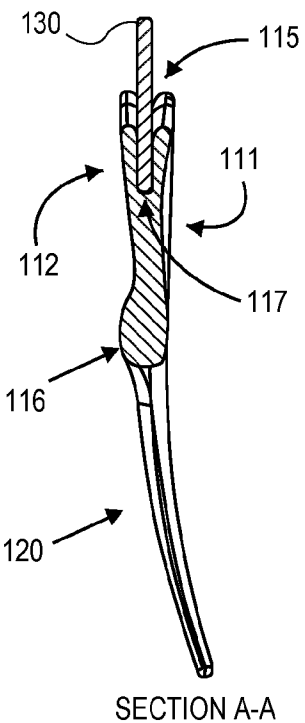
FIG. 3 is a sectional view taken along A-A of FIG. 2.
Figure 4:
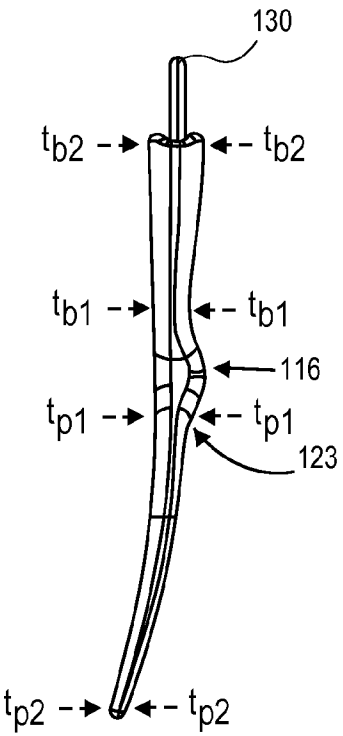
FIG. 4 is a left-side elevational view of the tool from FIG. 1.
Figure 5:
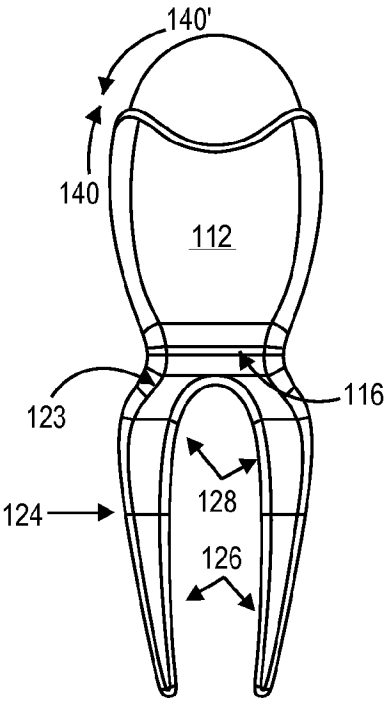
FIG. 5 is a rear plan view of the tool from FIG. 1.

FIG. 1 is a perspective view of a green repair tool in accordance with the example embodiments; FIG. 2 is a front plan view of the tool from FIG. 1; FIG. 3 is a sectional view taken along A-A of FIG. 2; FIG. 4 is a left-side elevational view of the tool from FIG. 1; and FIG. 5 is a rear plan view of the tool from FIG. 1. Referring to FIGS. 1-5, the green repair tool 100 includes a body 110. The body 110 extends between an upper end 115 terminating in a generally crescent shape as shown, and a lower end 114 from which extends a pair of prongs 120 in spaced relation that are contiguous with and extend downward therefrom. The prongs 120 terminate at prong tips 122. In general, the tool 100 has a generally hourglass shape in a front view with a narrowing width (see at 118 in FIG. 2) at the body lower end 114 from which the prongs 120 extend.

As best shown in FIGS. 3 and 4, the body 110 includes a horizontal contour ridge 116. Contour ridge 116 juts or protrudes jutting generally outward from a rear surface 112 of the body 110 at lower end 114 of the body 110. The contour ridge 116 tapers so as to form rear upper end portions 123 of the prongs 120. A thickness of the body 110 increases from an upper end of the contour ridge 116 (see $t_{b1}$) toward the upper end 115 of body 110 (see $t_{b2}$, $t_{b2}>t_{b1}$). Additionally, a thickness of each prong 120 decreases from a lower end of the contour ridge 116 (see $t_{p1}$) toward the prong tips 122 (see $t_{p2}$, $t_{p2}<t_{p1}$).

The front surface 111 of body 110 includes a depression 113. Depression 113 is formed in the body 110 above the prongs 120 and is designed to receive a thumb of a user. A boundary transition 119 encircles the depression 113. In an example, the boundary transition 119 distinguishes the texture of metal within depression 113 from the metal texture of the reminder of the front and rear surfaces 111, 112. Similarly, each prong 120 includes a boundary transition 124 there around, as best shown in FIGS. 2, 4 and 5 encircling each prong 120. The boundary transition 124 distinguishes the texture of metal in region 126 of prong 120 from the metal texture in region 128 of prong 120.

Accordingly, the body 110 and prong regions 128 (outside of the boundary transitions 124 and 119 as described above) in one example may be formed of a textured zinc alloy over an inner copper or nickel plating base for durability. Alternatively, chrome could be used for the body 100. The depression 113 (up to transition 119) and regions 126 of the prongs 120 below transitions 124 may be formed of a gloss zinc-alloy. As zinc is a diamagnetic metal, it weakly repels magnetic fields. Thus the body 110/prongs 120 are not designed to be highly magnetic so as to attract an object, such as the ball marker 130, in itself. Rather than the material makeup of the body 110/prongs 120 being magnetic, other features of tool 100 to be described in further detail below provide ball marker 130 retention functions.

Although zinc alloy with differing textures thereof have been described for the body 110 and prongs 120 of tool 100, other materials having similar properties may be used, as is evident to the skilled artisan, which are comparable to zinc and/or an alloy thereof.

Figure 7:
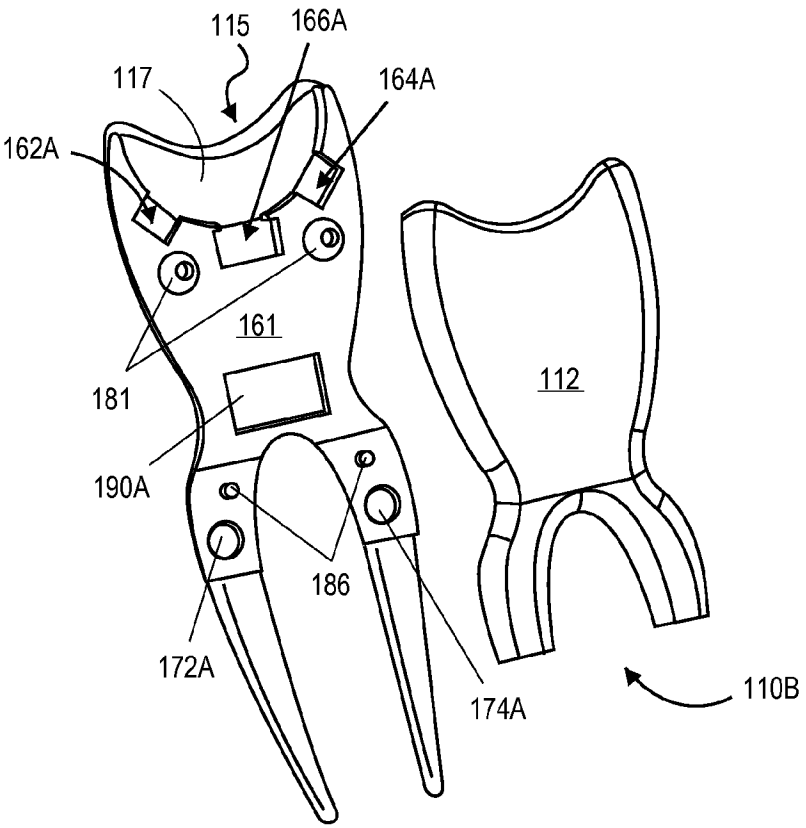
FIG. 7 is a partial exploded view of the tool from a rear perspective to illustrate selected interior components thereof.
Figure 6:
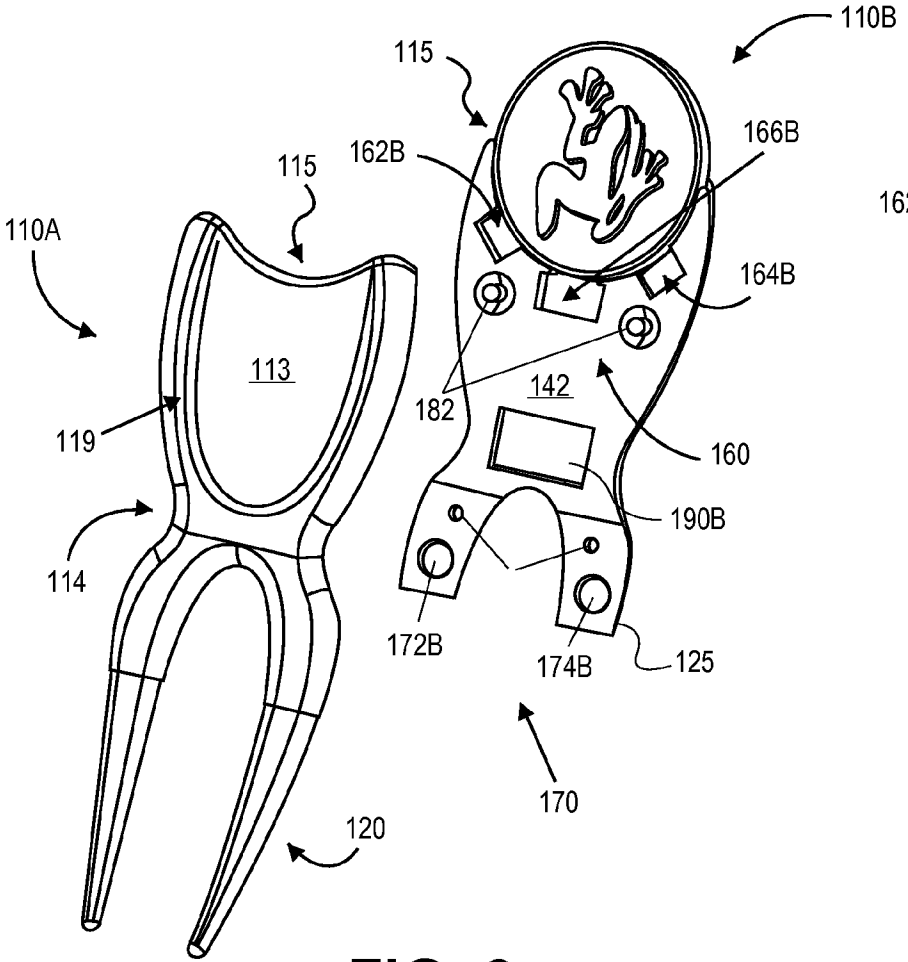
FIG. 6 is a partial exploded view of the tool from a front perspective to illustrate selected interior components thereof.

FIG. 6 is a partial exploded view of the tool from a front perspective to illustrate selected interior components thereof, and FIG. 7 is a partial exploded view of the tool from a rear perspective to illustrate selected interior components thereof. Referring now to FIG. 6 for purposes of explanation, body 110 may be composed of a front half portion 110*a* inclusive of prongs 120 and a rear half portion 110*b* which includes prong stub extensions 125. The figure is shown with the two body halves in spaced relation so as to expose a rear facing surface 142 of rear half portion 110*b* which contains relevant components of a retention means for the ball marker 130 thereon.

The crescent-shaped upper end 115 in each half portion 110*a*, 100*b* includes semicircular ridges in mirror image relation that together form the semi-circular recess 117, oriented downward from upper end 115 into the body 110. The recess 117 is dimensioned to receive the removable ball marker 130 so as to be fixedly retainable within the recess 117 by a retention means. In an example, marker 130 may be formed of metal having magnetic properties, nickel being just one example, although the example embodiments are not so limited. Alternatively, the ball marker 130 can have an inner copper base plating core with a zinc alloy or chrome coating overlay and one or more layered clear coatings there upon. The ball marker 130 may be embodied with or without textured elements thereon. In one example, less than 50% of the total surface area of the marker 130 is exposed above the crescent-shaped upper end 115 with the marker 130 inserted within the recess 117 of the tool 100 at its upper end 115.

In another example, greater than 50% of the total surface area of ball marker 130 is retained within the recess 117 of the tool 100. In a further example, the percentage of the ball marker 130 exposed above the crescent-shaped upper end 115 is in a range of 40% to 49% of the total surface area of the ball marker 130. This range is significant in that retention means within tool 100 to be described hereafter, coupled with the design of the upper end 115, securely retains ball marker 130 so long as the surface area exposure of marker 130 above the upper end 115 is within this surface area range. This range is additionally necessary to provide adequate sufficient surface area to allow a user to grasp and easily remove (such as between thumb and forefinger) the ball marker 130 out of the recess 117 at the upper end 115. Moreover, if the ball marker 130 is hit or impacted from any angle while in the recess 117, it will not come out of the tool 100 with only 40-49% of the surface area exposed (and hence the remainder within tool 100).

Referring to any of FIGS. 1, 2 and 5, for example, the dimensions and/or profile of the crescent-shaped upper end 115 are designed so as to meet circumferential or outer profile dimensions of the ball marker 130. This can be seen by directional arrows 140 and 140' in FIG. 5 for example. The profile of the tapered sides of the curved upper end 115 meeting the curvature of the ball marker 130 provides a body 110 with marker 130 therein that assumes a substantially ovular shape upon marker 130 insertion within the recess 117. This may facilitate retention of the marker 130 within the tool 110 in combination with additional retention means described hereafter.

Referring again to FIGS. 6 and 7, the green repair tool 100 can function as a golf accessory, namely as a ball mark retention device, and/or as a device combining divot repair and ball marker retention functions, e.g., "a combination". For the following discussion green repair tool shall be referred to as a golf accessory or combination 100 in order to describe the example retention means thereof for ball marker 130.

The retention means shown in FIG. 6 is described as an example; the placement of magnets being a mirror image in FIG. 7. Referring to FIG. 6 as an example, there is provided in the accessory or combination 100 a first plurality of magnets 160 embedded in the body 110, namely in rear half portion 110*b* adjacent and around a periphery of the semi-circular recess 117 in spaced relation thereof. Accessory or combination 100 includes a second plurality of magnets 170 embedded in the spaced prongs 120. In one example, the magnets may be positioned within the body 110 and prongs 120 so that at least 60% of the surface area of the accessory is magnetic.

The first plurality 160 may include magnets 162*b*, 164*b* and 166*b* adjacent to a lower end of the semi-circular recess 117 within the rear half portion 110*b*. As shown, these magnets are slightly recessed or sunken below the rear facing surface 142 of the rear half portion 110*b*. Corresponding mirror image magnets are provided in front half portion 110*a* shown in FIG. 7. In each of the front and rear half portions 110*a*/110*b*, at least a portion of one of the first plurality 160 of magnets is exposed within the recess 117; this is shown in both FIGS. 6 and 7.

The second plurality 170 include single magnets 172*b* and 174*b*, each embedded in an upper end of corresponding prong 120 below where the prong 120 meets the body lower end 114. As shown in FIG. 6, rear half portion 110*b* extensions 125 support these magnets 172*b*, 174*b*; in FIG. 7, front half portion 110*a* includes magnets 172*a*, 174*a* in mirror image relation.

Additionally, each of the front and rear half portions 110*a*/110*b* may include a central magnet 190*a*, 190*b* in mirror image relation. Like the magnets of the first and second pluralities 160, 170, magnets 190*a*, 190*b* may be arranged in slightly recessed or sunken fashion within or below rear facing surfaces 142, 161.

In the examples of FIGS. 6 and 7, providing a golf accessory and/or combination 100 having the arrangement of magnets thereon may in another embodiment realize a tool/accessory/combination 100 in which at least 70% of the external surface area thereof has the ability to retain the ball marker 130 thereto, not including the recess 117. In another example, additional magnets such as 172*a/b*, 174*a/b* may be placed down part of the length of each prong 120, or an additional magnet may be placed on rear facings 142/161 between 190*a/b* and the first plurality 160 to realize a tool/accessory/combination 100 in which up to at least 80% of the external surface area of the tool 100 is receptive to holding the ball marker 130 thereon. Accordingly, the orientation and placement of the magnets shown in FIGS. 6 and 7 and/or described hereinabove provide a tool/accessory/combination 100 in which a percentage of in a range of between 60% to 80% the total outer surface area thereof is receptive to holding the ball marker 130 thereto. As described, this is due to location and placement of a retention means within the body 110; not as a result of a magnetic outer body material.

Although groupings of three, five or six magnets have been shown in FIGS. 6 and 7 as example retention means, different combinations of magnet groupings in and around the recess 117, on the rear facings 142/161, and/or on the prongs 120 are foreseeable to the skilled artisan and therefore contemplated by the example embodiments.

The body 110 itself is thus not formed of a magnetic material; it is the location and placement of the magnets within the interior of the body 110 that enables realization of a retention means for ball marker 130 within the recess 117 and outside the body 110. Thus, in the event that ball marker 130 becomes dislodged within the golfer's pocket, the marker 130 will attract to one of the embedded magnets within the body 110 of the tool/accessory/combination 100 so that as the golfer grasps the tool 100, the ball marker 130 will be removably attached thereto, whether or not the marker 130 is properly seated within the recess 117. Accordingly, the desirability of the outside surface area of the tool 100, namely a substantial surface area portion of the body attracting the ball marker 130 thereto by way of the embedded retaining means and not a magnetic body material itself provides a way in which a golfer can quickly find their ball marker 130 even if it is not properly retained in recess 117; it is still attached to the tool 100.

Figure 8:
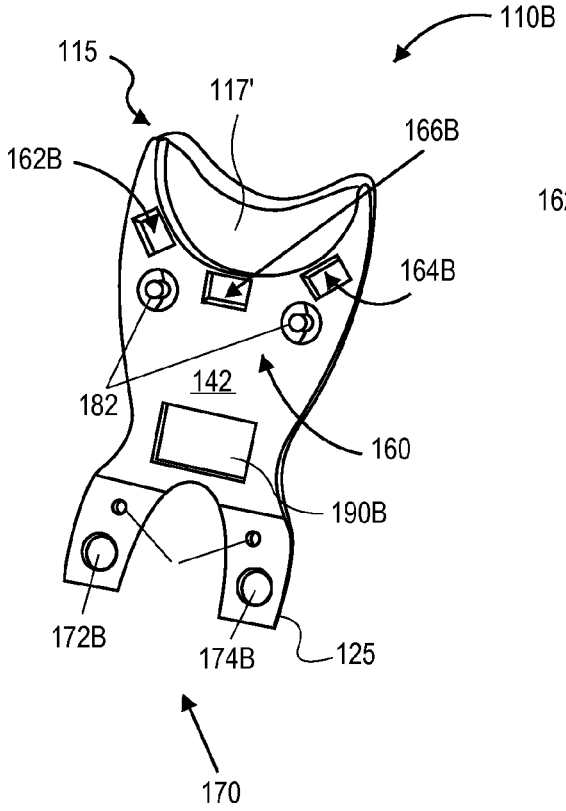
FIG. 8 is a partial view of a rear half portion of the body to illustrate selected interior components thereof in accordance with another example embodiment.
Figure 9:
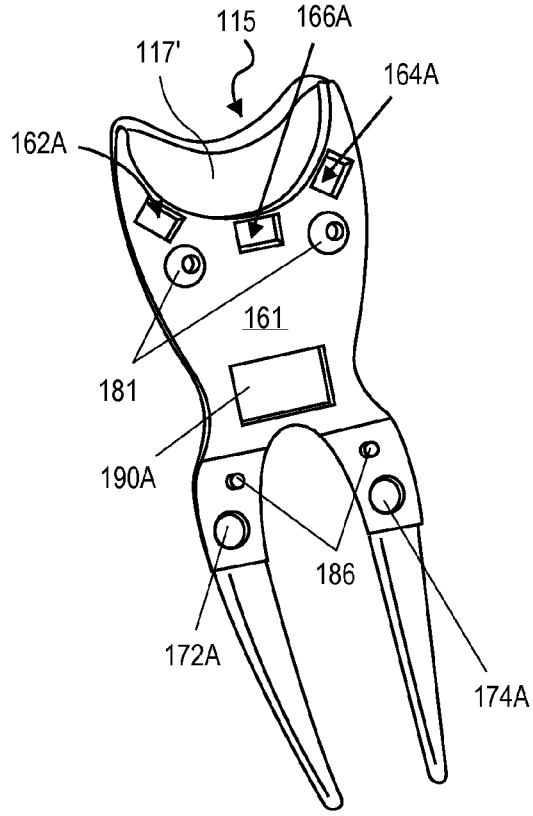
FIG. 9 is a partial view of a front half portion of the body to illustrate selected interior components thereof in accordance with another example embodiment.

FIG. 8 is a partial view of a rear half portion of the body to illustrate selected interior components thereof in accordance with another example embodiment; and FIG. 9 is a partial view of a front half portion of the body to illustrate selected interior components thereof in accordance with another example embodiment. As FIGS. 8 and 9 are similar to FIGS. 5 and 6, only differences are noted.

FIGS. 8 and 9 illustrate a slightly different embodiment that emphasizes the magnetic strength of the magnets used in the example embodiments. As an example, the magnets used in the interior of the body 110 (magnets 190*a*/190*b*) as well as in the prongs 120 (magnets 172*a/b*, 174*a/b*) have a portion of a material forming the body (zinc alloy) between the magnets themselves and the ball marker 130; yet the ball marker 130 can still be attracted to the magnets within the body 110. In other words, the strength of the magnets, coupled with a reduced wall thickness of the body material in the vicinity of the magnet(s) is sufficient that the magnet can still attract the ball marker 130 through the non-magnetic body 110.

The same principles may be used for in the modified rear half portion 110*b*' and front half portion 110*a*' shown in FIGS. 8 and 9, which realize a different structural recess 117'. Using FIG. 8 as an example, magnets 162*b*, 164*b* and 166*b* all have a material layer of rear facing 142 interposed between the magnets and recess 117' so that no portion of the magnets are in contact with any portion of the recess 117'. This is also shown in FIG. 9 as well. In a variant, the magnets of the first plurality could even be set off a few additional millimeters away from the edge of the recess 117', but still have sufficient attractive strength to fixedly retain marker 130 within recess 117' until overcome by the golfer pulling the marker 130 out from upper end 115.

The example embodiments being thus described, it will be obvious that the same may be varied in many ways. Such variations are not to be regarded as departure from the example embodiments, and all such modifications as would be obvious to one skilled in the art are intended to be included herein.

What is claimed is:

1. A green repair tool, comprising:

a body having a front surface, rear surface, upper end, lower end, left and right sides thereof, the upper end terminating in a generally crescent shape, a pair of spaced prongs contiguous with and extending downward from the lower end of the body to prong tips, a horizontal contour ridge jutting outward from the rear surface at approximately a midpoint of the body and tapering to form rear upper end portions of the prongs, the crescent-shaped upper end including a semi-circular recess formed downward within the body and dimensioned to receive a removable ball marker fixedly retainable within the recess wherein only between 40% to 49% of the total surface area of the marker is exposed above the crescent-shaped upper end upon full marker insertion within the recess.

2. The tool of claim 1, wherein the tool has a generally hour-glass shape in a front view with a narrowing width at the body lower end from which the prongs extend.

3. The tool of claim 1, further comprising:

a depression formed in the front surface of the body above the prongs, the depression configured to receive a thumb of a user, the depression having a boundary transition there around.

4. The tool of claim 3, wherein each prong has a boundary transition thereon, and the depression and prongs are formed of a gloss zinc-alloy up to the transitions, the remainder of the prongs and body formed of a textured zinc alloy.

5. The tool of claim 1, wherein a thickness of the body increases from an upper end of the contour ridge toward upper end of body.

6. The tool of claim 1, wherein a thickness of each prong decreases from a lower end of the contour ridge toward the tips.

7. The tool of claim 1, wherein the crescent-shaped upper end meets circumferential dimensions of the ball marker so that the body with marker therein assumes a substantially ovular shape upon marker insertion within the recess.

8. A golf accessory, comprising:

a body having a front surface, rear surface, upper end, lower end, left and right sides thereof, the upper end terminating in a generally crescent shape, the crescent-shaped upper end including a semi-circular recess formed downward within the body and dimensioned to receive a removable metallic ball marker fixedly retainable within the recess, a pair of spaced prongs contiguous with and extending downward from the lower end of the body to prong tips, a first plurality of magnets embedded in the body directly adjacent the semi-circular recess, and a second plurality of magnets embedded in the spaced prongs wherein the crescent-shaped upper end meets circumferential dimensions of the ball marker so that the body with marker therein assumes a substantially ovular shape upon marker insertion within the recess.

9. The accessory of claim 8, wherein the magnets are positioned within the body and prongs so that at least 60% of the total surface area of the accessory is receptive to retaining the ball marker thereon.

10. The accessory of claim 8, wherein the first plurality of magnets include three magnets in spaced relation adjacent to a lower end of the semi-circular recess within the body.

11. The accessory of claim 8, wherein the second plurality of magnets include a single magnet embedded in an upper end of each prong below where each prong meets the body lower end.

12. The accessory of claim 8, wherein at least a portion of one of the first plurality of magnets is exposed within the recess.

13. The accessory of claim 8, wherein a portion of a material forming the body is between one or more of the first plurality of magnets and the recess.

14. A combination golf ball marker retention and green repair tool device, comprising:

a body having a front surface, rear surface, upper end, lower end, left and right sides thereof, the upper end terminating in a crescent shape and including a semi-circular recess formed downward within the body and dimensioned to receive a removable metallic ball marker fixedly retainable within the recess, a horizontal contour ridge jutting outward from the rear surface of the body lower end and tapering to form rear upper end portions of the prongs, a pair of spaced prongs contiguous with and extending downward from the lower end of the body to prong tips, and a plurality of magnets embedded in the body and prongs so that at least 60% of the outer surface area of the device is receptive to retaining the ball marker thereon.

15. The combination of claim 14, wherein only between 40% to 49% of the total surface area of the marker is exposed above the crescent-shaped upper end when inserted within the recess.

16. The combination of claim 14, further comprising:

a depression formed in the front surface of the body above the prongs, the depression configured to receive a thumb of a user, the depression having a boundary transition there around, wherein each prong has a boundary transition thereon, and the depression and prongs are formed of a gloss zinc-alloy up to the transitions, the remainder of the prongs and body formed of a textured zinc alloy.

17. The combination of claim 14, wherein the plurality of magnets include three magnets in spaced relation adjacent to a lower end of the semi-circular recess within the body, and a single magnet embedded in an upper end of each prong below where each prong meets the body lower end.

18. The combination of claim 14, wherein at least a portion of one of the magnets is exposed within the recess.

19. The combination of claim 14, wherein a portion of a material forming the body is between one or more of the magnets and the recess.

20. The accessory of claim 8, wherein only between 40% to 49% of the total surface area of the marker is exposed above the crescent-shaped upper end upon marker insertion within the recess.

* * * * *